US005226976A

United States Patent [19]

Carlson et al.

[11] Patent Number: 5,226,976

[45] Date of Patent: Jul. 13, 1993

[54] METAL TREATMENT

[75] Inventors: Lawrence R. Carlson, Waterford; Philip M. Johnson, Southfield; John R. Pierce, Huntington Woods, all of Mich.

[73] Assignee: Henkel Corporation, Plymouth Meeting, Pa.

[21] Appl. No.: 685,355

[22] Filed: Apr. 15, 1991

[51] Int. Cl.[5] ..... C23C 22/83

[52] U.S. Cl. ..... 148/257; 148/265; 148/272; 148/275; 106/14.15

[58] Field of Search ..... 106/14.15, 14.16; 148/256, 274, 265, 257, 275, 272; 204/220

[56] References Cited

U.S. PATENT DOCUMENTS

| | | | |
|---|---|---|---|
| 3,682,713 | 8/1972 | Ries et al. | 148/6.14 R |
| 3,895,170 | 7/1975 | Tanaka | 106/14.16 |
| 3,912,548 | 10/1975 | Faigen | 148/6.15 R |
| 3,964,936 | 6/1976 | Das | 148/6.27 |
| 4,357,396 | 11/1982 | Grunewalder | 148/270 |
| 4,564,397 | 1/1986 | Opsahi | 148/257 |
| 4,612,236 | 9/1986 | Hsu | 106/14.16 |
| 4,656,097 | 4/1987 | Claffy | 148/256 |
| 4,963,596 | 10/1990 | Lindert et al. | 526/313 |
| 4,970,264 | 11/1990 | Lindert et al. | 525/328.8 |
| 5,102,457 | 4/1992 | Braig | 106/14.16 |

FOREIGN PATENT DOCUMENTS

| | | | |
|---|---|---|---|
| 0136182 | 8/1933 | Japan | 148/254 |
| 0163280 | 12/1981 | Japan | 148/257 |

*Primary Examiner*—Sam Silverberg

*Attorney, Agent, or Firm*—Wayne C. Jaeschke; Patrick J. Span; Norvell E. Wisdom, Jr.

[57] ABSTRACT

Seal coating compositions and method of applying same, to metallic surfaces, particularly aluminum or alloys thereof, containing a previously formed protective coating on the metal surface, to provide for improved corrosion resistance beyond that provided by the previously formed protective coating. Aqueous solutions of the seal coating components are applied to the metal surface containing the previously formed coating which is subsequently rinsed and dried to provide metal articles having improved resistance to corrosion.

24 Claims, 1 Drawing Sheet

METAL TREATMENT

BACKGROUND OF THE INVENTION

1. Field of the Invention

This invention relates to the field of protective and/or surface treatment of articles, particularly metal surfaces and to surface treatment compositions employed as solutions or dispersions and methods of using these compositions. The compositions coated on the metal surfaces provide improved corrosion resistance and adhesion of any subsequent overlaying coatings.

2. Statement of Related Art

In the art of treating metal surfaces, it is common practice to improve the corrosion resistance characteristics and bonding of subsequent coatings to the metal surface by depositing or coating the metal surface with a protective coating or film. In order to improve the qualities of the already applied protective coating, it is common to provide a second or subsequent coating after the initial protective coating has been formed on the metal surface. This second coating further enhances the corrosion resistance of the unpainted metal surface and to prepare the surface for reception of a final finish coating where one is to be employed, such as a paint, enamel or lacquer. In U.S. Pat. No. 3,912,548, assigned to Amchem Products, Inc., there is described an aqueous zirconium compound-polyacrylic acid coating composition which is applied to a metal surface already having deposited thereon a conversion coating, which results from treatment of a base metal surface with aqueous solutions which react with the metal surface. The conversion coatings described in the patent are chromate or phosphate coating.

Conversion coatings which include hexavalent chromium have been widely used in the past to protect metals such as iron, zinc, magnesium and aluminum or alloys of aluminum including those with manganese, copper, zinc, silicon and magnesium. While such chromium coatings provide good corrosion resistance properties, recent attempts have been made to produce acceptable chromate-free coatings because of growing concern regarding pollution effects of the chromate and phosphate, particularly hexavalent chromium, discharged into rivers and waterways, which results in extensive waste treatment procedures being required to control their discharge. In U.S. Pat. No. 3,964,936, assigned to Amchem Products, Inc., there is reported and described various attempts to develop chromium-free aluminum coating solutions and describes a zirconium coating solution, which may also include boric acid. In describing coating solutions Examples 29 and 30 in the patent, which include sodium nitrate and cobalt nitrate, $Co(NO_3)_2 \cdot 6H_2O$, reference is made also to U.S. Pat. No. 3,682,713, which includes a sodium nitrite component in a coating solution for steel and galvanized steel as well as aluminum.

U.S. Pat. Nos. 4,963,596 and 4,970,264 assigned to Henkel Corporation, describe the use of modified polyphenol compounds, which may be used in the "post-treatment" of conversion coated metal surfaces.

DESCRIPTION OF THE INVENTION

Figure 1:
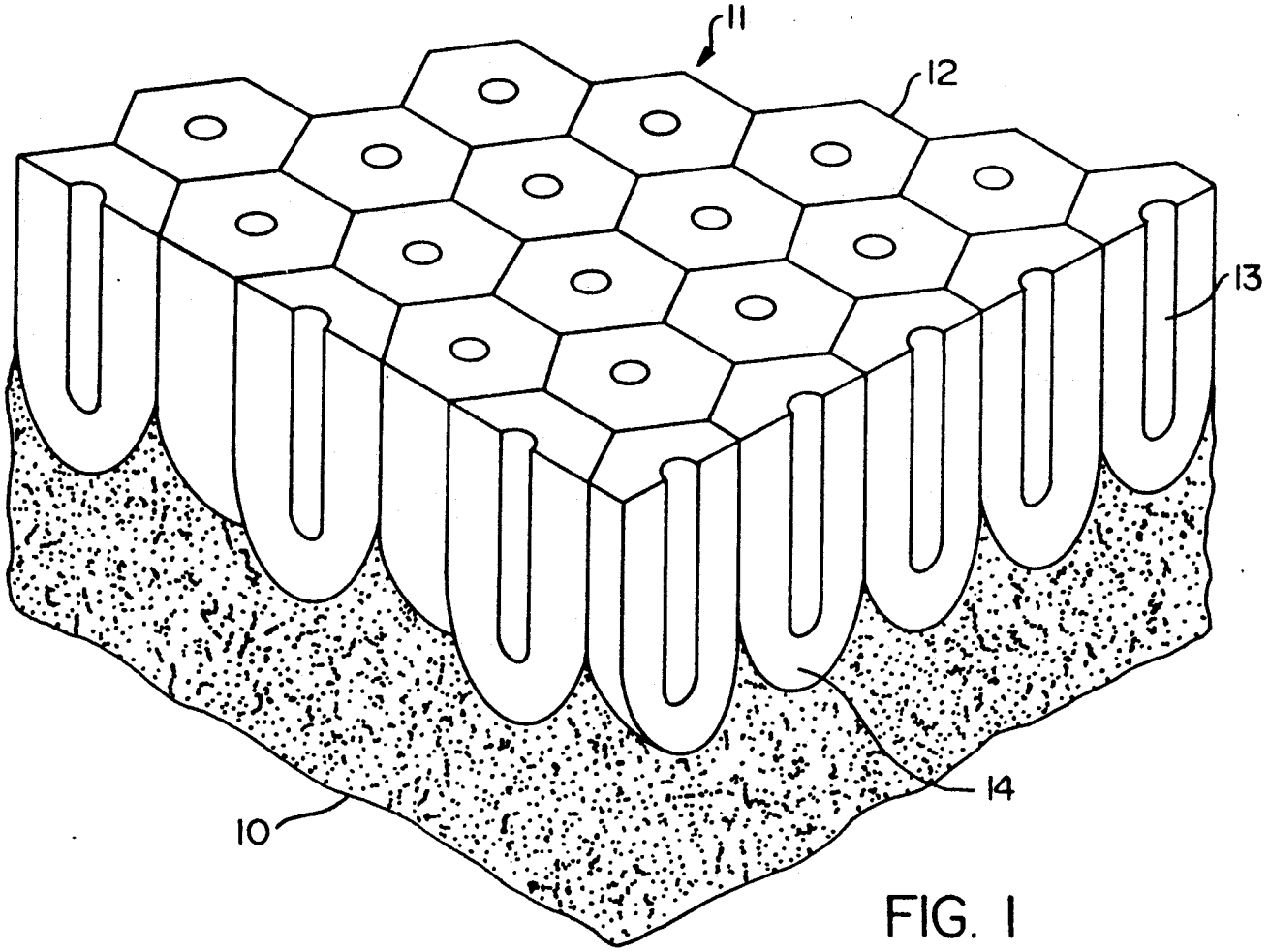
FIG. 1 is an enlarged view of one species, a cell and pore structure, of metal coating which may be improved further by the compositions of the present invention.

In this description, except in the working examples and claims, and wherever expressly indicated to the contrary, all numerical specifications of amounts of materials, or conditions of reaction or use, are to be understood as modified by the term "about" in describing the broadest scope of the invention. Practice of the invention within the exact numerical limits is however, generally preferred.

The present invention provides for compositions, solutions and dispersions, and methods for use in treatment of metal surfaces already having a protective coating or film thereon. The compositions of the present invention accordingly deal with a post-treatment or secondary coating to further improve the corrosion resistance of the metal surface and to provide or retain adhesion properties for application of other coatings, where desired, such as paints, enamels, lacquers or other protective or decorative coatings. This secondary coating acts to seal the already applied protective coating on the metal surface.

The metal surfaces which may be treated in accordance with the present invention may be any metal surface, including iron, zinc, magnesium, steel metal surfaces, including galvanized steel, aluminum or alloys thereof with metals such as copper, zinc, manganese, silicon and magnesium.

Virtually any metal surface, containing a protective or decorative coating or film thereon, may be treated by the seal coatings and compositions of the present invention. The invention is thus directed to an overlay composition to seal the initial coating on the metal surface, which initial coating or film may be of any type. The invention is thus applicable to conversion coatings, such as the chromate and/or phosphate coatings employed on aluminum or aluminum alloys or the more recently developed chromate-free coatings such as those of U.S. Pat. No. 3,964,936 discussed earlier. The invention is not only applicable to conversion coatings, but also any coating or film, smooth or porous, which may be improved by the overlay coating or film of the present invention, including anodic or anodized aluminum or magnesium coatings, which are then sealed or coated by composition of the present invention. The invention is particularly applicable to seal coatings of a tubular pore or cell structure, such as those shown in FIG. 1, in which a metal surface 10, such as aluminum, has a coating formed of a tubular porous structure 11 having hexagonal shape cells 12, extending upward from the metal surface with pores 13 extending into the cells, the lower levels of the cells forming a barrier layer 14 at the interface of the metal and the coating or film. Such a structure as shown in FIG. 1 having a hexagonal shaped cell or wall structure, resembling a bee hive cell structure, is found in anodized aluminum coatings. With other coatings, non-conversion coatings, similar structures may result in the formation of the coating with a tubular pore structure extending upwardly from the metal surface, in which the shape of the tubular structure may, instead of hexagonal, be circular, oval, triangular, square, rectangular, diamond shape or other configuration, which contain pores extending downwardly. The coating compositions of the present invention are particularly effective in sealing such tubular pore structures, the compositions extending into the pores, with the penetration and depth into the core determining the effectiveness of the seal coating.

It is accordingly clear that the coating or sealing compositions of the present invention may be applied to any protective coated metal surface or article to improve the corrosion resistance or protective properties and to improve adhesion of other overlying protective or decorative coatings, such as paints, etc. mentioned earlier, where such are desired.

The initial protective coated metal surface or article, which is then treated in accordance with the present invention, is prepared in the conventional manner known to those in the art, either by (a) conversion coating techniques, chromate and phosphate or chromate-free conversion coatings, (b) anodized coatings of aluminum or magnesium oxides, or (c) other continuous film, smooth or porous coatings. In general, conversion coatings which react with the metal surface, or non-conversion coatings, which are not reactive with the metal surface, but which may form a layer or film coating adhered to the metal surface, are formed by cleaning the metal surface with an acid or alkaline cleaning (which are readily available commercially) and deoxidized, if necessary, followed by a water rinse and application of the protective coating composition, which is applied in the usual, conventional manner for the particular metallic article. Such application methods will include, immersion, spray coating, roller coating, flow-coating, and the like, After the coating solution has been applied to the metal surface, it is generally rinsed with water, preferably including a deionized water rinse after which the coated article is dried, conveniently in an oven having forced circulation of hot air typically at temperatures up to 450° F. for metals generally with temperatures of up to about 200° F. preferred for aluminum and similar metals. Other available drying methods can be used, including air drying at ambient temperatures, usually about 20°-23° C.

The protective coated metal article is then treated in accordance with the present invention, with the coating composition described in more detail below, applied in the manner described to provide metal articles having improved corrosion resistance and providing enhanced adhesion properties.

The treating compositions of the present invention to provide a seal coating overlaying the initial protective coating of the metal surface are of various types, with the particular type to be employed, generally dependent on the particular metal surface or article and type of initial coating, i.e. anodized, conversion, non-conversion, tubular pore structure and the like. The compositions are particularly useful in relation to aluminum substrates, which is used in the aerospace industry, auto industry and in cans and house sidings, and any application where corrosion resistance and adhesion properties are required.

The seal coating compositions of the present include inorganic and organic coating compositions which are employed in a liquid, generally aqueous composition in which the components are dissolved in water, and are formulated so as to contain in the working solution form, either as an immersion or dipping bath, or as a spray or other coating form, from about 25-5000 ppm, preferably 500-2000 ppm of the active coating components or ingredients.

Inorganic compositions are mixtures of nickel sulfate, manganese sulfate or cobalt nitrate, boric acid and ammonium nitrate. The preferred inorganic compositions have the following formulations:

| Formula | Components | grams/liter (g/l) |
|---|---|---|
| (a) | $NiSO_4.6H_2O$ | 8 |
| | $MnSO_4.H_2O$ | 8 |
| | $H_3BO_3$ | 20 |
| | $NH_4NO_3$ | 16 |
| (b) | $NiSO_4.6H_2O$ | 8 |
| | $Co(NO_3)_2.6H_2O$ | 8 |
| | $H_3BO_3$ | 20 |
| | $NH_4NO_3$ | 16 |

In the formulations above, the total amount of the nickel sulfate and manganese sulfate, and similarly of the nickel sulfate and cobalt nitrate in formulation (b) is at a level of 16 grams/liter. The amount may however vary from about 12-20 g/l. In addition the ratios of these components by weight in the preferred compositions are 1:1. The ratio of the nickel sulfate to the manganese sulfate in formulation (a) or to the cobalt nitrate in formulation (b) may vary however from 1:5 to 5:1. In some cases it may be desirable to replace the nickel sulfate completely with the manganese sulfate or the cobalt nitrate.

Further, while the preferred composition employs boric acid $H_3BO_3$ it is to be understood that the borates, ammonium or alkali metal borates, such as sodium and potassium may be employed, either as a full or partial replacement for the acid. While other borates may also be employed, the acid is preferred and the ammonium or alkali metal borates are more desirable than others. The boric acid content in the formulations may also be varied from about 15-25 g/l. It is preferred that the amount of boric acid employed be in an amount by weight substantial equal to or in slight excess (up to about 20%) of the amount of ammonium nitrate employed and to the mixture of nickel and manganese sulfate or mixture of nickel sulfate and cobalt nitrate. The ammonium nitrate may vary also from about 10-30 g/l.

An organic coating formulation preferred is an aqueous solution of an azole, either aromatic or aliphatic. The preferred azoles are the triazole compounds containing up to 18 carbon atoms, such as alkyl and aryl triazoles. The preferred aryl triazoles are those containing about 6-10 carbon atoms, including benzotriazole and tolyltriazole, and preferred alkyl triazoles are those containing 1-6 carbon atoms, such as methyl triazole. Such triazoles are commercially available from PMC Specialties Group, Inc., Cincinnati, Ohio under the tradename "COBRATEC", such as COBRATEC 700, 725, 99 or TT-100. The benzotriazole (COBRATEC 99), CAS No. 95-14-7 is available as an off-white to light yellow flake and tolyltriazole (COBRATEC TT-100), CAS #29385-43-1 is available as tan to light brown granules.

The triazoles are dissolved in water at levels of from about 0.1-5 grams/liter, preferably about 2-3 grams/-liter and are employed in a working immersion bath in a concentration of about 25-5000 ppm, preferably about 500 to 2000 ppm. The pH of the triazole treating solutions as employed will be in the range of about 5-12 and will be adjusted conventionally by appropriate acid or base.

The triazoles ideally may be employed in admixture with certain polyphenol polymer compounds, earlier referred to herein and described in commonly assigned U.S. Pat. No. 4,963,596 for use in a "post-treatment" of metal surfaces previously treated with a conversion coating composition. These polyphenol polymer compounds are described beginning at column 4, line 7 through column 7, line 52 of the U.S. Pat. No. 4,963,596, which description is included below. The materials may generally be described as homo- or copolymers of phenol compounds which contain a "Z" moiety as defined below and in which at least a portion of said "Z" moiety must contain a polyhydroxyalkyl amine functionality resulting from the condensation of an amine or $NH_3$ and a ketose, aldose or other alkyl aminopolyhydroxy compound having from about 3 to about 8 carbon atoms followed by reduction to an amine.

POLYMER MATERIAL (A)

In accordance with the present invention a polymer useful in metal treatment applications is selected from polymer Materials (a)-(d). Polymer Material (a) comprises a polymer material having at least one unit having the formula:

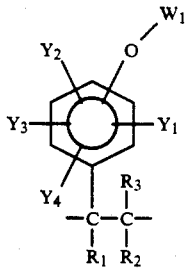

wherein:

$R_1$ through $R_3$ are independently selected for each of said units from the group consisting of hydrogen, an alkyl group having from 1 to about 5 carbon atoms, or an aryl group having about 6 to about 18 carbon atoms;

$Y_1$ through $Y_4$ are independently selected for each of said units from the group consisting of hydrogen, $-CR_{11}R_5OR_6$, $-CH_2Cl$, or an alkyl or aryl group having from 1 to 18 carbon atoms, or Z;

Z is

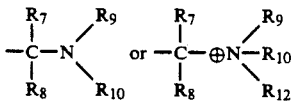

however, at least a fraction of the $Y_1$, Y, $Y_3$ or $Y_4$ of the final compound or material must be Z and at least a fraction of said Z must contain a polyhydroxy alkylamine functionality resulting from the condensation of an amine or $NH_3$ and a ketose, aldose or other alkylaminopolyhydroxy compound having from about 3 to about 8 carbon atoms followed by reduction to an amine (from the imine);

$R_5$ through $R_{12}$ are independently selected for each of said units from the group consisting of hydrogen, an alkyl, aryl, hydroxy-alkyl, amino-alkyl, mercapto-alkyl, or phospho-alkyl moiety; $R_{12}$ can also be $-O^{(-1)}$ or $-OH$, in order to form an amine oxide or a hydroxyl amine;

$W_1$ is independently selected for each of said units from the group consisting of hydrogen; an acyl moiety; an acetyl; a benzoyl moiety; 3-allyloxy-2-hydroxy-propyl-; 3-benzyloxy-2-hydroxy-propyl; 3-alkylbenzyloxy-2-hydroxy-propyl-; 3-phenoxy-2-hydroxy-propyl-; 3-alkylphenoxy-2-hydroxy-propyl-; 3-butoxy-2-hydroxy-propyl; 3-alkyloxy-2-hydroxy-propyl; 2-hydroxyoctyl-; 2-hydroxy-alkyl-; 2-hydroxy-2-phenylethyl-; 2-hydroxy-2-alkyl phenyl ethyl-; benzyl-; methyl-; ethyl-; propyl-; alkyl-; allyl; alkyl benzyl-; haloalkyl-; haloalkenyl; 2-chloro-propenyl-; sodium, potassium; tetra aryl ammonium; tetra alkyl ammonium; tetra alkyl phosphonium; tetra aryl phosphonium; or a condensation product of ethylene oxide, propylene oxide, a mixture, or copolymer thereof.

Preferred final materials are based on a vinyl phenolic moiety or methyl vinyl phenolic moiety. For example, vinyl phenol or isopropenyl phenol and derivatives thereof may be used.

It will be appreciated that the depiction above represents a repeating unit that characterizes the compound or materials of the present invention; no terminating end units are depicted. The end group not depicted of the polymers of the present invention can be selected by the skilled artisan relying upon art-disclosed techniques. For example, the end groups of the polymer may be either those resulting from the specific polymerization process employed or those intentionally added to alter the polymer characteristics. For example, the end groups may be hydrogen, hydroxyl, initiation fragments, chain transfer agents, disproportionation groups, or other groups resulting from similar methods of terminating a growing polymer chain.

POLYMER MATERIAL (B)

Polymer Material (b) comprises a polymer material having at least one unit having the formula:

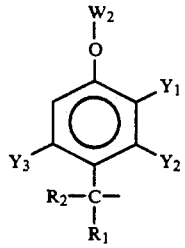

wherein:

$R_1$ through $R_2$ are independently selected for each of said units from the group consisting of hydrogen, an alkyl group having from 1 to about 5 carbon atoms, or an aryl group having from about 6 to about 18 carbon atoms;

$Y_1$ through $Y_3$ are independently selected for each of said units from the group consisting of hydrogen, $-CR_4R_5OR_6$, $-CH_2Cl$, an alkyl or aryl group having from 1 to 18 carbon atoms, or Z, Z is

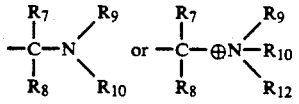

but at least a fraction of the $Y_1$, $Y_2$ or $Y_3$ of the final compound must be Z, and at least a fraction of said Z must contain a polyhydroxy alkyl-amine functionality resulting from the condensation of an amine or $NH_3$ and a ketose, aldose or other alkylaminopolyhydroxy compound having from about 3 to about 8 carbon atoms;

$R_4$ through $R_{12}$ are independently selected for each of said units from the group consisting of hydrogen, or an alkyl, aryl, hydroxy-alkyl, amino-alkyl, mercapto-alkyl or phospho-alkyl moiety; $R_{12}$ may also be $O^{(-1)}$ or —OH in order to form an amine oxide or a hydroxyl amine;

$W_2$ is independently selected for each of said units from the group consisting of hydrogen; an acyl moiety; acetyl; benzoyl; 3-allyloxy-2-hydroxy-propyl-; 3-benzyloxy-2-hydroxy-propyl-; 3-alkylbenzyloxy-2-hydroxy-propyl-; 3-phenoxy-2-hydroxy-propyl-; 3-alkylphenoxy-2-hydroxy-propyl-; 3-butoxy-2-hydroxy-propyl-; 3-alkyloxy-2-hydroxy-propyl-; 2-hydroxyoctyl-; 2-hydroxy-alkyl-; 2-hydroxy-2-phenyl-ethyl-; 2-hydroxy-2-alkyl-phenylethyl-; benzyl-; methyl-; ethyl-; propyl-; alkyl; allyl-; alkylbenzyl-; haloalkyl-; haloalkenyl; 2-chloro-propynyl-; or a condensation product of ethylene oxide, propylene oxide, a mixture, or co-polymer thereof;

POLYMER MATERIAL (C)

Polymer Material (c) comprises a co-polymer material wherein at least one portion of said co-polymer has the structure:

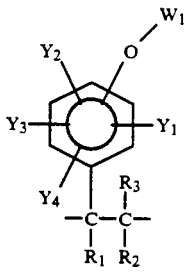

and at least a fraction of said portion is polymerized with one or more monomers having a C=C moiety. Useful monomers include those independently selected for each of said units from the group consisting of acrylonitrile, methacrylonitrile, methyl acrylate, methyl methacrylate, vinyl acetate, vinyl methyl ketone, isopropenyl methyl ketone, acrylic acid, methacrylic acid, acrylamide, methacrylamide, n-amyl methacrylate, styrene, m-bromostyrene, p-bromostyrene, pyridine, diallyl-dimethylammonium salts, 1,3-butadiene, n-butyl acrylate, tert-butylamino-ethyl methacrylate, n-butyl methacrylate, tert-butyl methacrylate, n-butyl vinyl ether, tert-butyl vinyl ether, m-chlorostyrene, o-chlorostyrene, p-chlorostyrene, n-decyl methacrylate, N,N-diallylmelamine, N,N-di-n-butylacrylamide, di-n-butyl itaconate, di-n-butyl maleate, diethylaminoethyl methacrylate, diethyleneglycol monovinyl ether, diethyl fumarate, diethyl itaconate, diethyl vinylphosphonate, vinylphosphonic acid, diisobutyl maleate, diisopropylitaconate, diisopropyl maleate, dimethyl fumarate, dimethyl itaconate, dimethyl maleate, di-n-nonyl fumarate, di-n-nonyl maleate, dioctyl fumarate, di-n-octyl itaconate, di-n-propyl itaconate, n-dodecyl vinyl ether, ethyl acid fumarate, ethyl acid maleate, ethyl acrylate, ethyl cinnamate, N-ethylethacrylamide, ethyl methacrylate, ethyl vinyl ether, 5-ethyl-2-vinylpyridine, 5-ethyl-2-vinylpyridine 1-oxide, glycidyl acrylate, glycidyl methacrylate, n-hexyl methacrylate, 2-hydroxyethyl methacrylate, 2-hydroxypropyl methacrylate, isobutyl methacrylate, isobutyl vinyl ether, isoprene, isopropyl methacrylate, isopropyl vinyl ether, itaconic acid, lauryl methacrylate, methacrylamide, methacrylic acid, methacrylonitrile, N-methylolacrylamide, N-methylolmethacrylamide, N-isobutoxymethylacrylamide, N-isobutoxymethylacrylamide, N-alkyloxymethylacrylamide, N-alkyloxymethylmethacrylamide, N-vinyl-caprolactam, methyl acrylate, N-methylmethacrylamide, α-methylstyrene m-methylstyrene, o-methylstyrene, p-methylstyrene, 2-methyl-5-vinylpyridine, n-propyl methacrylate, sodium p-styrenesulfonate, stearyl methacrylate, styrene, p-styrenesulfonic acid, p-styrenesulfonamide, vinyl bromide, 9-vinylcarbazole, vinyl chloride, vinylidene chloride, 1-vinylnaphthalene, 2-vinylnaphthalene, 2-vinylpyridine, 4-vinylpyridine, 2-vinylpyridine N-oxide, 4-vinylpyrimidine, N-vinylpyrrolidone; and $W_1$, $Y_1$–$Y_4$ and $R_{1-12}$ are as in (a), above.

Within such materials, the ratio of any single monomer to any other monomer can be about 1:99 to about 99:1, preferably about 5:1 to about 1:5, and more preferably 1.5:1 to about 1:1.5.

POLYMER MATERIAL (D)—CONDENSATE POLYMERS

By the term "condensation polymers" is meant the following:

A condensation polymer of polymer materials (a), (b), or (c), wherein condensable forms (i.e., modified as noted below) of (a), (b), or (c), or mixtures thereof, is condensed with a second compound selected from the group consisting of phenols (preferably phenol, alkylphenol, arylphenol, cresol, resorcinol catechol, pyrogallol), tannins, (both hydrolyzable and condensed) novolak resins, lignin compounds, together with aldehydes, ketones or mixtures thereof, to produce a condensation resin product, that is a prepolymer of Polymer Material (d). This condensation resin prepolymer product is then further reacted by the addition of "Z" to at least a portion of it by reacting said resin prepolymer product with an aldehyde or ketone and a secondary amine producing a final adduct which can react with an acid and/or can be reacted with hydrogen peroxide to generate an amine oxide. The amine oxide can then be acid neutralized to form the hydroxyl amine if desired.

While this condensation product is described for convenience as being prepared by a sequential reaction, it will be appreciated that these materials can be prepared by carrying out the necessary steps in any order, or simultaneously. However, the sequence described is preferred.

It is appreciated by those skilled in the art, that the alkenylphenolic moieties of the present invention can be either randomly distributed within the copolymer and terpolymer or can be synthesized to constitute a block orientated polymer, depending upon the methods and conditions used for polymerization.

Preferred aldoses, ketoses, and derivatives for use in the above materials include, without limitation, glucose, fructose, alditols such as mannitol, aribanose, mannose, ribose, ribitol, and the like. Acids such as aldonic and aldaric acids may also be employed. Disaccharides and polysaccharides that can be easily hydrolyzed under reaction conditions to one or more of the useful aldoses and ketoses may also be employed.

As disclosed in U.S. Pat. No. 4,963,596 the polyphenol compounds thereof were useful in the "post-treatment" of already conversion coated metal surfaces. It was discovered that the polyphenol compounds of the patent, described above, may also be employed alone in the post treatment of non-conversion coated metal surfaces. The polyphenol compounds are particularly effective as a post-treatment coating in sealing tubular core structure, non-conversion coatings, which were described earlier. Thus, while the patent teaches only the post-treatment by the polyphenol compounds for conversion coating, which were reactive with the metal surface, the present invention provides post-treatment of other coatings provided such previously applied protective coating has a porous tubular structure. The polyphenol polymer material, providing it contains the amine functionality through the "Z" moiety or defined, provides for greatly improved corrosion resistance and adhesion properties for any subsequent decorative or protective coatings. In the Z moiety defined earlier, $R_9$ is preferably an hydroxyethyl or glucose group and $R_{10}$ is preferably methyl with the remaining groups $R_7$–$R_{12}$ being hydrogen. The polymer is employed in an aqueous solution which will vary in pH from about 0.5 to about 14, preferably about 3–12.

In each of the treatment compositions of the present invention, the composition comprises an effective amount of the treatment compound dissolved or dispersed in a carrier suitable for surface treatment of the previously coated metal surface. Generally, the carrier is water in which the active treatment compounds are soluble or dispersible. However, small amounts of polar organic solvents, such as an alcohol and/or glycols including glycol ethers, may be employed to promote solubility and dispersibility.

Ideally, the post-treatment with composition is carried out immediately after the initial protective coating is formed on the metal surface and no drying step is required after the first coating is applied. The seal coating accordingly proceeds without delay after rinsing which follows the initial coating step. Following directly after the first coating application eliminates any drying step of the first coating or any further rinsing or cleaning of the first coating application. The method or process of coating in the present invention accordingly comprises contacting a metal surface having a protective coating thereon with a liquid composition comprising at least one of the compositions of this invention as described above, thereby sealing said initial protective coating and providing improved corrosion resistance. After application of the seal coating composition, the surface is preferably rinsed before drying, however, good results can be obtained without rinsing for many end uses. While room temperature drying can be employed, use of elevated temperatures up to about 450° F., with temperatures up to about 200° F. preferred for aluminum and similar metals, is preferred to decrease the amount of drying time required.

The thickness of the final dry coating, including the initial coating on the metal surface will depend on its purpose or functions and will typically range from about 0.0001 mil to about 0.05 mil, preferably 0.0001 to about 0.01 mil. Additional cleaning or rinsing step is required before the seal coating treatment of the present invention.

In the seal treatment, the solution can vary over a relatively wide range of concentration. Useful levels will range from about 0.001% by weight up to about 10%, and more preferably up to about 5%. Practically speaking concentrations of about 0.001% to about 1–2% are preferred.

As noted earlier, the seal treatment can be applied by any conventional manner including immersion or dipping, spray coating, roller coating, wipe or brush, thixotropic or non-thixotropic, viscous or non-viscous and the like. The temperature of the solution applied can vary over a wide range, but is preferably from about 70° F. to about 220° F. In an immersion application times of from about 5 to about 30 minutes will generally be adequate. The time of application can be reduced substantially however by other application methods, such as spray coating.

Further understanding of the present invention, can be had from the following examples. As used herein "salt spray" refers to salt spray corrosion resistance measured in accordance with ASTM-B-117-61. In reporting the results, the numerical rating of 10 would indicate no pits in the surface while a rating of 9 indicates up to about 2 pits, while a rating of 5 indicates about 20–30 pits. A rating of 0 would indicate pits of about 100 upwards.

EXAMPLE

In order to illustrate and evaluate the improved corrosion resistance employing the seal coating compositions of the present invention, 3 inch by 5 inch samples of 2024 T3 aluminum alloy, 0.032 inch thickness, coated with a chromate-free conversion coating were coated with the seal coating compositions of the present invention as described below in more detail. The starting samples were prepared by conventional means including degreasing, cleaning, etching and deoxidizing, desmutting, rinsing and a non-chromate containing coating applied by immersion for 30 minutes at about 125° F. followed by an immersion rinse at 140° F. for 5 minutes. The samples were then seal coated by immersion in the aqueous solution of the present invention for 15 minutes at 180° F. followed by an immersion rinse in tap water for 3 minutes at ambient temperature. The samples were then air dried at ambient temperature.

The samples were then tested for salt spray resistance in accordance with ASTM-B-117-61 with the results noted below. The seal formulations employed as aqueous solutions were as follows:

| Component | Concentration (g/l) |
|---|---|
| Formulation A (inorganic): | |
| $NiSO_4.6H_2O$ | 8 |
| $MnSO_4.H_2O$ | 8 |
| $H_3BO_3$ | 20 |
| $NH_4NO_3$ | 16 |
| Formulation B (inorganic): | |
| $NiSO_4.6H_2O$ | 8 |
| $Co(NO_3)_2.6H_2O$ | 8 |
| $H_3BO_3$ | 20 |
| $NH_4NO_3$ | 16 |

Formulations A and B, having initial pH values of 3.4 and 4.0 respectively, were then each adjusted with potassium hydroxide to a pH of 5.5.

Formulation C, an organic formulation, was an aqueous solution of a commercially available triazole, COBRATEC 725 in a concentration of 2 grams/liter, which provided a solution at a pH of 9.5.

Formulation D, an organic polymer, a poly (vinylphenol), was prepared as an aqueous solution of the polymer in water at a concentration of 2% by weight, which had a pH of 6.7. The polymer was Parcolene® 95AT of Parker+Amchem Division of Henkel Corporation, a methyl glucamine derivative of a poly (vinylphenol) resin (Resin M obtained from Maruzen Oil having a molecular weight of about 5000).

The results of the ASTM salt spray test can be seen from Table I below, the ratings being an average of testing of 10 panels in accordance with the ASTM method.

TABLE I

| Formulation | Salt Spray Results (168 Hrs.) Rating | No. of Pits |
|---|---|---|
| A | 9 | 0-2 |
| B | 9 | 0-2 |
| C | 10 | 0 |
| D | 10 | 0 |
| None (no seal coat) | 0 | >100 |

The foregoing illustrate the improved corrosion resistance by the seal coatings of the present invention. Photomicrographs (10,000× and 50,000×) of the panels containing the chromate-free protective coating before sealing reveal a tubular pore structure in which the cells containing the pores are of circular or oval cross section, extending upwardly from the aluminum surface, the bottom of cells forming a barrier layer above the surface of the aluminum. As can be seen from the results above, this barrier layer is insufficient to provide significant corrosion resistance, the panels without any seal coat failing within 168 hours having a rating of 0 (>100 pits). In contrast, the panels containing the same initial chromate-free coating, when sealed with the compositions of the present invention, provided significant resistance to corrosion showing virtually no pits for coatings on the order of 9-10, after exposure to 168 hours.

As can be seen from the foregoing, seal coating formulations are provided for a wide range of pH levels and the optimum pH levels will vary for the specific formulations. The inorganic formulations above are particularly pH dependent and generally provide the most desirable results at pH levels above 4 to about 7, i.e. 4.5 to 7, with optimum results generally within a pH range of about 5-6. The organic compositions are somewhat less pH dependent and vary over a wide pH range of application, particularly the polymer type which may be applied in the range of preferably about 3-12, with the more desired results generally in the pH range of about 6-10.

While the triazole coating was exemplified with COBRATEC 725, the other available COBRATEC products, TT-100 (tolyltriazole) and 99 (benzotriazole) and mixtures of tolyltriazole and benzotriazole will provide substantially similar results. Mixture of the triazole products and polymer, which may be applied within the pH range of 4-12, may provide for the desirable properties of each of the organic seal coatings.

What is claimed is:

1. A process for increasing the corrosion resistance of a metal object bearing a pre-existing protective conversion coating, said process comprising steps of:

(A) contacting the pre-existing coating with a composition having a pH from about 5 to about 12 and consisting essentially of:

(1) water, (2) from 25-5000 ppm of triazole molecules selected from the group consisting of aryl triazoles containing from 6 to about 10 carbon atoms and alkyl triazoles containing from 1 to about 6 carbon atoms, and, optionally, (3) at least partially substituted poly(vinylphenol) polymer or copolymer including substituents on at least some of the phenol rings that have a chemical structure according to one of the formulas:

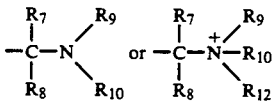

wherein each of $R_5$ through $R_{12}$ is selected from hydrogen, an alkyl, an aryl, an aryl, a hydroxyalkyl, an amino-alkyl, a mercapto-alkyl, or a phospho-alkyl moiety, except that $R_{12}$ can also be $—O^{(-1)}$ or —OH and that at least one of $R_9$ and $R_{10}$ must include a polyhydroxy functionality resulting from the condensation of an amine or ammonia with a ketose, aldose, or other polyhydroxyl compound having from about 3 to about 8 carbon atoms, followed by reduction from imino to amino, and, optionally, (4) polar organic solvents; and (B) drying the object completion of step (A).

2. A process according to claim 1, comprising an additional step of rinsing the treated surface between steps (A) and (B).

3. A process according to claim 2, wherein the pre-existing coating has a structure including cells and pores.

4. A process according to claim 1, wherein the pre-existing coating has a structure including cells and pores.

5. A process according to claim 4, wherein the metal is aluminum, magnesium, or an aluminum or magnesium alloy.

6. A process according to claim 3, wherein the metal is aluminum, magnesium, or an aluminum or magnesium alloy.

7. A process according to claim 2, wherein the metal is aluminum, magnesium, or an aluminum or magnesium alloy.

8. A process according to claim 1, wherein the metal is aluminum, magnesium, or an aluminum or magnesium alloy.

9. A process according to claim 8, wherein the pre-existing coating is an aluminum or magnesium oxide coating formed by anodization.

10. A process according to claim 7, wherein the pre-existing coating is an aluminum or magnesium oxide coating formed by anodization.

11. A process according to claim 6, wherein the pre-existing coating is an aluminum or magnesium oxide coating formed by anodization.

12. A process according to claim 5, wherein the pre-existing coating is an aluminum or magnesium oxide coating formed by anodization.

13. A process according to claim 12, wherein the concentration of triazole molecules in the composition used in step (A) is from 500 to 2000 ppm.

14. A process according to claim 11, wherein the concentration of triazole molecules in the composition used in step (A) is from 500 to 2000 ppm.

15. A process according to claim 10, wherein the concentration of triazole molecules in the composition used in step (A) is from 500 to 2000 ppm.

16. A process according to claim 9, wherein the concentration of triazole molecules in the composition used in step (A) is from 500 to 2000 ppm.

17. A process according to claim 8, wherein the concentration of triazole molecules in the composition used in step (A) is from 500 to 2000 ppm.

18. A process according to claim 7, wherein the concentration of triazole molecules in the composition used in step (A) is from 500 to 2000 ppm.

19. A process according to claim 6, wherein the concentration of triazole molecules in the composition used in step (A) is from 500 to 2000 ppm.

20. A process according to claim 5, wherein the concentration of triazole molecules in the composition used in step (A) is from 500 to 2000 ppm.

21. A process according to claim 4, wherein the concentration of triazole molecules in the composition used in step (A) is from 500 to 2000 ppm.

22. A process according to claim 3, wherein the concentration of triazole molecules in the composition used in step (A) is from 500 to 2000 ppm.

23. A process according to claim 2, wherein the concentration of triazole molecules in the composition used in step (A) is from 500 to 2000 ppm.

24. A process according to claim 1, wherein the concentration of triazole molecules in the composition used in step (A) is from 500 to 2000 ppm.

* * * * *